US005281132A

United States Patent [19]

Wymaster

[11] Patent Number: 5,281,132

[45] Date of Patent: Jan. 25, 1994

[54] COMPACT COMBUSTOR

[76] Inventor: Noel A. Wymaster, 2817 Sierra Vista Way, Bishop, Calif. 93514

[21] Appl. No.: 930,360

[22] Filed: Aug. 17, 1992

[51] Int. Cl.[5] ..... F23D 14/46

[52] U.S. Cl. ..... 431/351; 431/353; 431/354; 431/185

[58] Field of Search ..... 239/403; 431/353, 354, 431/351, 352, 183, 185

[56] References Cited

U.S. PATENT DOCUMENTS

| | | | |
|---|---|---|---|
| 1,500,103 | 7/1924 | Burdon et al. | 431/183 |
| 1,531,959 | 3/1925 | Lefebvre | 431/183 |
| 2,220,828 | 11/1940 | Riley | 431/185 |
| 2,787,319 | 4/1957 | Ryder | 431/185 |
| 3,923,251 | 12/1975 | Flournoy | 431/351 |
| 3,951,584 | 4/1976 | Thekdi | 431/352 |
| 4,013,395 | 3/1977 | Wormser | 431/353 |
| 4,157,241 | 6/1979 | Samuelson | 431/353 |
| 4,507,075 | 3/1985 | Buss et al. | 431/352 |
| 4,687,436 | 8/1987 | Shigeta | 431/352 |

*Primary Examiner*—Carroll B. Dority
*Attorney, Agent, or Firm*—Robert M. Sperry

[57] ABSTRACT

An improved liquid fuel combustion device comprising a combustion chamber, a fuel inlet nozzle communicating with said combustion chamber, means for delivering a stream of turbulent air into said combustion chamber in a manner to cause liquid fuel to flow into an mix with said air stream, and means for igniting the mixture. If desired, additional air may be provided to promote more complete burning of the fuel.

11 Claims, 2 Drawing Sheets

COMPACT COMBUSTOR

BACKGROUND

1. Field of Invention

This invention relates to combustion devices and is particularly directed to compact, high-efficiency, liquid fuel burning combustion devices for use in space heaters, water heaters and the like.

2. Prior Art

Combustion device for liquid fuels have long been known and many prior art devices have been proposed to improve the efficiency and to minimize the size of such combustion devices. Unfortunately, many of the prior art devices have been complex in structure and operation and have been expensive to produce and maintain. Other prior art devices have reduced size, but have also reduced efficiency. Still other prior art devices have been extremely dangerous to operate and have been subject to fire or explosion, with attendant hazard to adjacent structures and people. Also, many prior art combustion devices have provided only partial combustion and, hence, have resulted in releasing substantial quantities of toxic or pollutant emissions. A search in the United States Patent Office has revealed the following:

| U.S. Pat. No. | INVENTOR | ISSUED |
|---|---|---|
| 4,168,803 | H. C. Simmons et al | Sep. 25, 1979 |
| 4,595,143 | H. C. Simmons et al | Jun. 17, 1986 |
| 4,773,596 | R. R. Wright et al | Sep. 27, 1988 |
| 4,842,197 | B. Simon et al | Jun. 27, 1989 |

Each of these references is subject to the limitations discussed above. Thus, none of the prior art liquid fuel combustion devices have been entirely satisfactory.

BRIEF SUMMARY AND OBJECTS OF INVENTION

These disadvantages of the prior art are overcome with the present invention and an improved liquid fuel combustion device is proposed which is extremely simple and compact in size and inexpensive to produce and operate, yet which is easy, safe and efficient in operation and produces virtually no hazardous or pollutant emissions.

These advantages of the present invention are preferably attained by providing an improved liquid fuel combustion device having a combustion chamber, a fuel inlet nozzle communicating with said combustion chamber, means for delivering a stream of turbulent air into said combustion chamber in a manner to cause liquid fuel to flow into an mix with said air stream, and means for igniting the mixture. If desired, additional air may be provided to promote more complete burning of the fuel.

Accordingly, it is an object of the present invention to provide an improved combustion device.

An additional object of the present invention is to provide an improved combustion device for liquid fuel.

Another object of the present invention is to provide an improved liquid fuel combustion device which is simple and compact in construction and inexpensive to produce.

A further object of the present invention is to provide an improved liquid fuel combustion device which is safe, easy and efficient to operate.

Another object of the present invention is to provide an improved liquid fuel combustion device which produces virtually no hazardous or pollutant emissions.

A specific object of the present invention is to provide an improved liquid fuel combustion device comprising a combustion chamber, a fuel inlet nozzle communicating with said combustion chamber, means for delivering a stream of turbulent air into said combustion chamber in a manner to cause liquid fuel to flow into an mix with said air stream, and means for igniting the mixture. If desired, additional air may be provided to promote more complete burning of the fuel.

These and other objects and features of the present invention will be apparent from the following detailed description, taken with reference to the figures of the accompanying drawing.

DETAILED DESCRIPTION OF THE INVENTION

Figure 2:
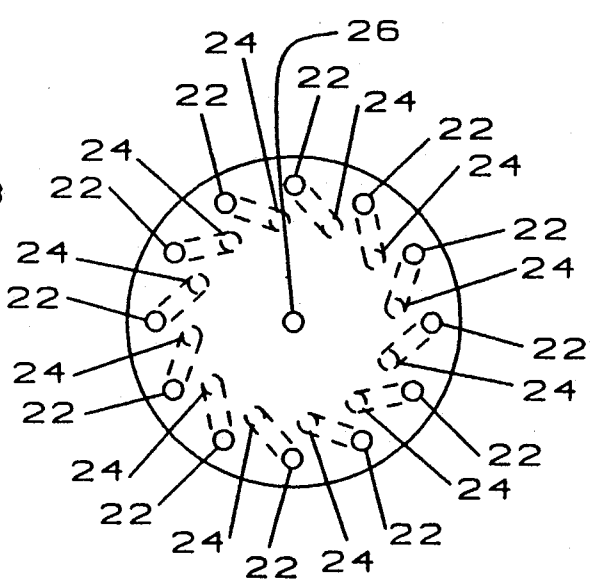
FIG. 2 is an end view of the nozzle.
Figure 1:
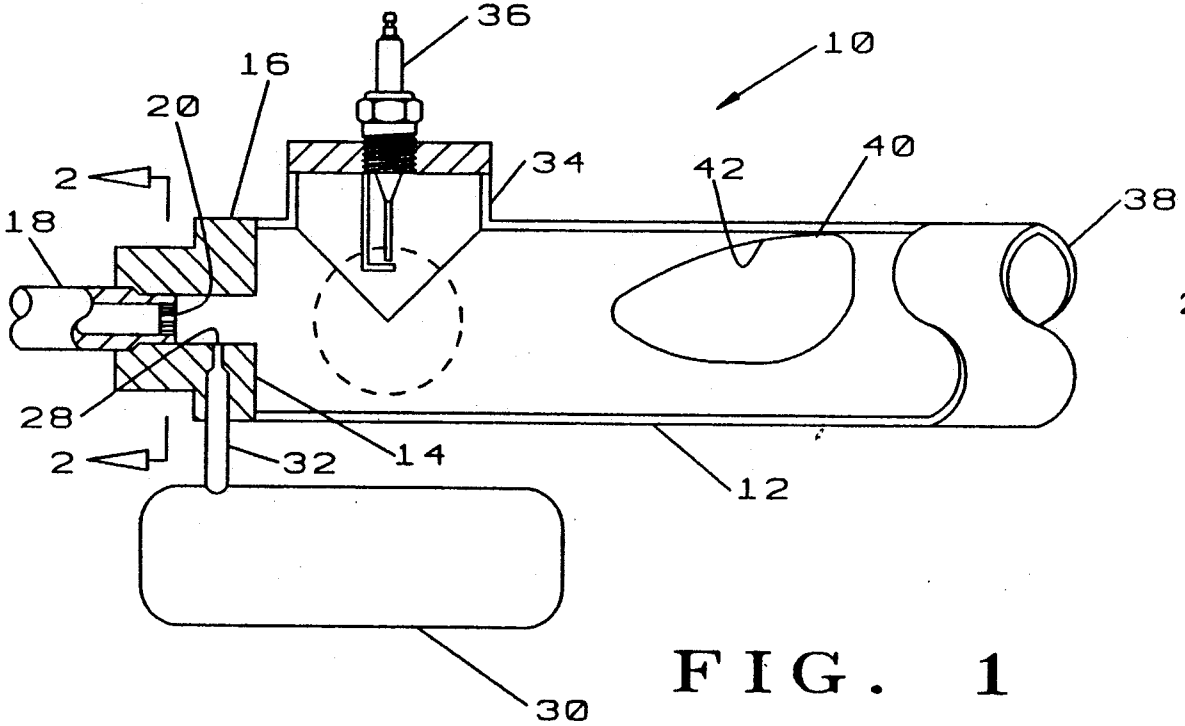
FIG. 1 is a longitudinal section through a combustion device embodying the present invention.
Figure 4:
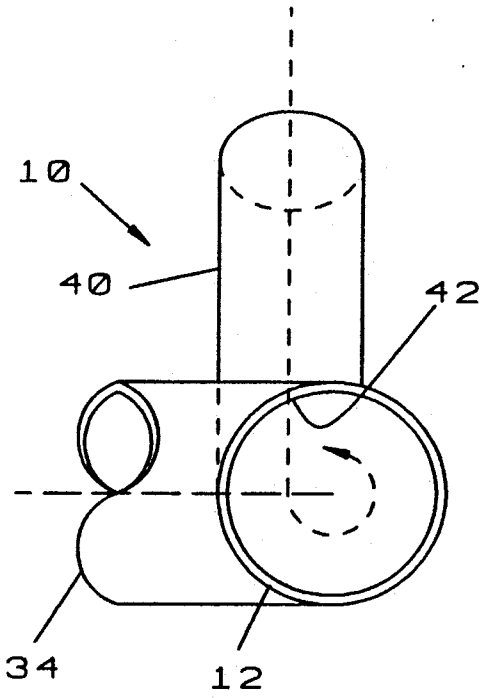
FIG. 4 is a top view of the combustion device of FIG. 1.
Figure 3:
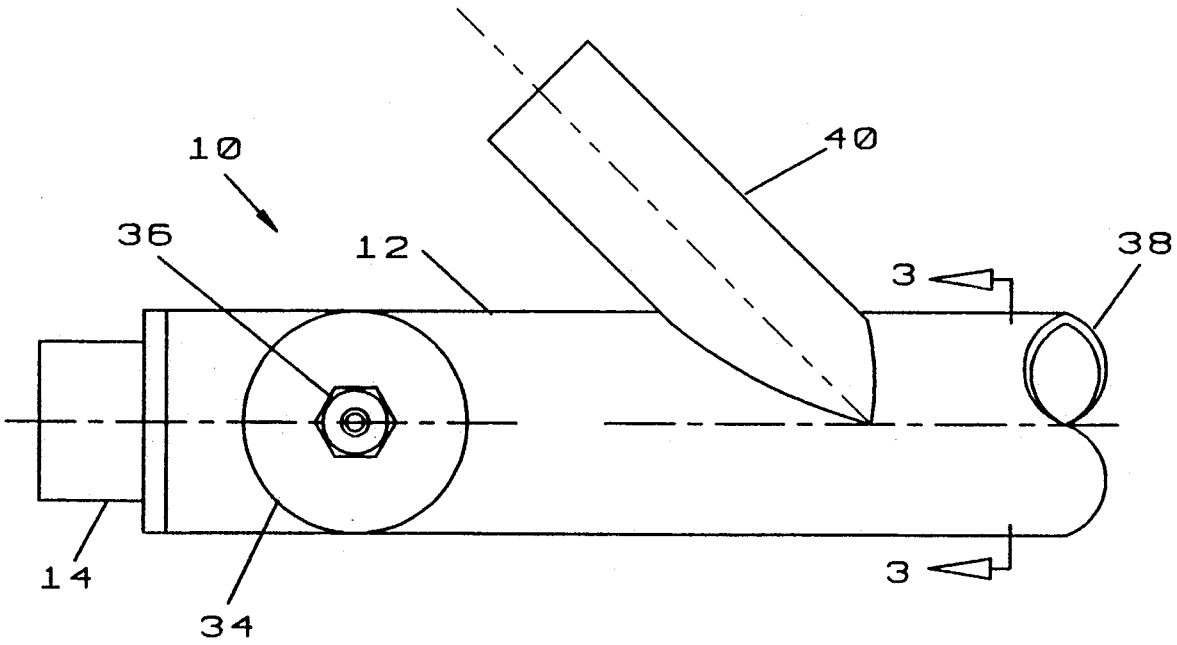
FIG. 3 is a vertical section through the combustion device of FIG. 1, taken on the line 3—3 of FIG. 1.

In that form of the present invention chosen for purposes of illustration in the drawing, FIG. 1 shows a combustion device, indicated generally at 10, having a combustion chamber 12 with an air and fuel inlet means 14 entering one end 16 of the combustion chamber 12. Pressurized air from a suitable source, not shown, is supplied through conduit 18, preferably under pressure, and is introduced through air inlet nozzle 20 into the combustion chamber 12 in a turbulent manner. It will be understood that the air may be compressed air stored in a suitable pressure bottle, not shown, or may be atomspheric air which is driven by a suitable pump, not shown. Such pressure bottles and air pumps are well known and the specific means employed to provide the pressurized air does not constitute a part of the present invention and, hence, is not shown. As best seen in FIG. 2, the air inlet nozzle 20 is formed with a plurality of passages 22 extending therethrough. Also, it should be noted that the outlet openings 24 of the passages 22 are canted or offset, laterally and radially, from the inlet openings, seen in dotted lines, of the air inlet nozzle 20 so as to impart a swirling motion to the air passing through the passages 22 to create turbulent air flow within the combustion chamber 12. If desired, a central opening 26 may be provided, extending axially through the air inlet nozzle 20, to cause the swirling mass of turbulent air from the passages 22 to travel along the combustion chamber 12. Between the air inlet nozzle 20 and end 16 of the combustion chamber 12, a fuel nozzle 28 introduces liquid fuel, supplied from a suitable source 30 through conduit 32. As the air from air inlet nozzle 20 moves past fuel nozzle 28, the movement of the air will produce a Venturi effect at the fuel nozzle 28, which will atomize the liquid fuel and will draw liquid fuel out of the fuel nozzle 28 into the stream of turbulent air from the air inlet nozzle 20 without the requirement for a fuel pump. Also, the turbulent, swirling action, imparted by the offset of the air passages 22, serves to promote thorough mixing of the fuel and air as this mixture travels into the combustion chamber 12. Preferably, the fuel source 30 is located below the level of the combustion chamber 12, as shown. Consequently, in the absence of air flow from the air inlet nozzle 20, no fuel flow will occur. This prevents undesired leakage of fuel and, since no fuel pump is required, the structure, purchase cost and maintenance of the combustion device 10 are all minimized. Moreover, if desired, a plurality of interchangeable air and fuel inlet means 14 may be provided, each having a respective length, to permit variation of the distance between the air inlet nozzle 20 and the combustion zone 34. Alternatively, suitable means, not shown, may be provided for adjustably varying the location of the nozzle 20 to accomplish such variation. The combustion chamber 12 is preferably formed with an enlarged area 34, which houses a suitable ignition means, such as spark plug 36, and which serves as the combustion zone of the combustion chamber 12. Combustion of the mixture of air and fuel begins in the combustion zone 34 and continues as the burning mixture continues to travel along the length of the combustion chamber 12 toward the exhaust end 38. As seen in FIGS. 1, 3 and 4, additional air may be supplied from a suitable source, not shown, through air duct 40 which enters the combustion chamber 12 tangentially, as seen at air inlet 42 in FIG. 1, so that the additional air will impart further swirling and turbulence and, hence, will promote more complete combustion of the fuel.

In use, the operator opens a valve or starts a pump, not shown, to initiate the flow of pressurized air through air duct 18 and air inlet nozzle 20 into end 16 of the combustion chamber 12. As noted above, the offset structure of the air passages 22 of air inlet nozzle 20 serve to impart a swirling motion to the stream of air passing through the air inlet nozzle 20. As this turbulent stream of air passes the fuel nozzle 28, the motion of the air causes a Venturi effect which draws fuel from the supply tank 30, through conduit 32 and fuel nozzle 28, causing the fuel to enter and mix with the stream of air from the air inlet nozzle 20. The motion of the stream of air from air inlet nozzle 20 also serves to cause the mixture of fuel and air to travel along the combustion chamber 12 and, hence, to enter the combustion zone 34, where the ignition device 36 ignites the mixture. Burning of the mixture of air and fuel occurs, primarily, in the combustion zone 34, but continues as the motion of the air from air inlet nozzle 20 moves the burning mixture onward along the length of the combustion chamber 12 toward the exhaust end 38. If desired, additional air may be supplied, through air duct 40 and inlet 42. Due to the tangential location of the air inlet 42, air entering through air inlet 42 causes additional swirling and turbulence to the burning mixture of fuel and air and, thus, promotes more complete combustion of the fuel as the burning mixture continues to move toward the exhaust end 38 of the combustion chamber 12. At the exhaust end 38, the products of combustion pass out of the combustion device 10 and may pass through suitable heat exchange means and exhaust means, as is conventional.

As noted above, the pressurized air may be supplied from a pressure bottle through a suitable flow control valve, in a conventional manner, to eliminate the need for an air pump. At the same time, the turbulent movement of air from air inlet nozzle 20 flowing past the fuel nozzle 28 serves to cause the fuel to enter and thoroughly mix with the air, thus, avoiding the need for a fuel pump. Similarly, locating the fuel supply 30 below the level of the combustion device 12 prevents undesired fuel flow. Consequently, combustion device of the present invention may have no moving parts and, hence, the structure, cost and maintenance of the combustion device of the present invention are greatly reduced. Moreover, the swirling, turbulent motion of the air from the air inlet nozzle 20 assures complete and thorough mixing of the fuel with the air and causes the mixture to travel into the combustion zone 34 for ignition by the ignition means 36 and causes the burning mixture to continue moving through the combustion chamber 12 to the exhaust end 38. Because of the turbulent mixing of the air and fuel, complete combustion of the air-fuel mixture is obtained. Furthermore, if desired, additional air may be introduced through air duct 40 and inlet 42 to insure that total combustion of the fuel occurs within the combustion device 10 or, if desired to reduce the temperature of the products of combustion passing out of the exhaust end 38. This also permits the size of the combustion device 10 to be reduced to minimal dimensions to provide an extremely compact and efficient combustion device.

Obviously, numerous variations and modifications can be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A combustion device comprising: a cylindrical combustion chamber including an end wall across an entry end, a cylindrical passage through said end wall, and an exhaust end, a source of pressurized air, a nozzle mounted in said cylindrical passage and connected to said source of pressurized air, said nozzle having at least one passage formed to discharge air from said source into said cylindrical passage at an angle to an axis of said cylindrical passage to cause air to swirl through said cylindrical passage into said combustion chamber, a source of liquid fuel at atmospheric pressure located at a level below said cylindrical passage, conduit means connecting said fuel source with said cylindrical passage through an opening in a wall of said cylindrical passage between said nozzle and said cylindrical combustion chamber wherein liquid fuel will be aspirated into said pressurized air in said cylindrical passage, and igniting means in said combustion chamber.

2. The combustion device of claim 1 wherein:
said nozzle having an inlet opening for said passage which is offset from the outlet opening of said passage.

3. The combustion device of claim 2 wherein:
said inlet opening is offset laterally from said outlet opening.

4. The combustion device of claim 2 wherein:
said inlet opening is offset radially from said outlet opening.

5. The combustion device of claim 2 wherein:
said inlet opening is offset laterally and radially from said outlet opening.

6. The combustion device of claim 1 wherein:
said nozzle has a plurality of said passages.

7. The combustion device of claim 1 further comprising:
at least one passage passing axially through said nozzle.

8. The combustion device of claim 1 wherein:
said source of pressurized air is an air bottle.

9. The combustion device of claim 1 further comprising:

means for supplying additional air into said combustion chamber between said ignition means and said exhaust end of said chamber.

10. The combustion device of claim 9 wherein:

said means for supplying additional air introduces said additional air into said chamber in a manner to promote turbulence within said chamber.

11. The combustion device of claim 10 wherein:

said means for supplying additional air causes said additional air to enter said combustion chamber in a tangential manner.

* * * * *